US009080785B2

(12) United States Patent
Kim et al.

(10) Patent No.: US 9,080,785 B2
(45) Date of Patent: Jul. 14, 2015

(54) DISPLAY DEVICE FOR AN AIR CONDITIONER AND AIR CONDITIONER HAVING THE SAME

(71) Applicant: LG ELECTRONICS INC., Seoul (KR)

(72) Inventors: Hyunjung Kim, Changwon-si (KR); Jongsun Jeon, Changwon-si (KR); Moonsung Kim, Changwon-si (KR); Grami Ryu, Changwon-si (KR); Jisun Lee, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 9 days.

(21) Appl. No.: 13/912,298

(22) Filed: Jun. 7, 2013

(65) Prior Publication Data

US 2014/0102664 A1 Apr. 17, 2014

(30) Foreign Application Priority Data

Oct. 12, 2012 (KR) ..... 10-2012-0113440

(51) Int. Cl.

| | |
|---|---|
| ***G06F 3/041*** | (2006.01) |
| ***F24F 11/00*** | (2006.01) |
| *F24F 1/00* | (2011.01) |

(52) U.S. Cl.

CPC ..... *F24F 11/0086* (2013.01); *F24F 2001/004* (2013.01); *F24F 2011/0091* (2013.01)

(58) Field of Classification Search

CPC ..... F24F 11/0086; F24F 2001/004; F24F 2011/0091

USPC ..... 345/173–178; 165/11.1

See application file for complete search history.

(56) References Cited

U.S. PATENT DOCUMENTS

2009/0267921 A1* 10/2009 Pryor ..... 345/177

FOREIGN PATENT DOCUMENTS

| | | | |
|---|---|---|---|
| CN | 102003775 A | * | 4/2011 |
| KR | 20100055204 A | * | 5/2010 |
| WO | WO 2007097515 A2 | * | 8/2007 |

OTHER PUBLICATIONS

English Translation of KR20100055204A, Jeong Young Kim, May 26, 2010.*

English Translation of CN 102003775 A, Fu X et al., Apr. 2011.*

* cited by examiner

*Primary Examiner* — Kent Chang
*Assistant Examiner* — Nelson Rosario
(74) *Attorney, Agent, or Firm* — Ked & Associates, LLP

(57) ABSTRACT

A display device of an air conditioner and an air conditioner having the same are provided. The display device may include a display including a film configured to allow display of an image corresponding to operation information of the air conditioner and that enables a touch input; a controller that controls display of the image; and a light emitting device that emits light toward the film. The controller may display the image on the display, receive a command concerning the operation information via the touch input, and change the image according to the touch input.

18 Claims, 10 Drawing Sheets

DISPLAY DEVICE FOR AN AIR CONDITIONER AND AIR CONDITIONER HAVING THE SAME

CROSS-REFERENCE TO RELATED APPLICATION(S)

This application claims priority to Korean Application No. 10-2012-0113440, filed in Korea on Oct. 12, 2012, which is hereby incorporated by reference in its entirety.

BACKGROUND

1. Field

A display device for an air conditioner and air conditioner having the same is disclosed herein.

2. Background

Display devices for air conditioners and air conditioners having the same are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Figure 1:
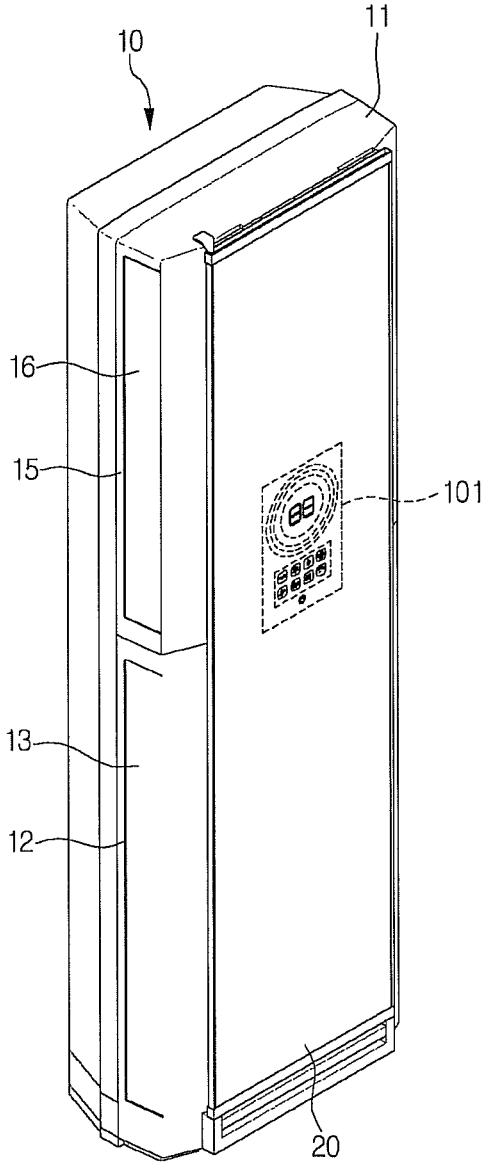
FIG. 1 is a schematic perspective view of an air conditioner according to an embodiment.

Reference will now be made in detail to embodiments, examples of which are illustrated in the accompanying drawings. Where possible, like reference numerals have been used to indicate like elements, and repetitive disclosure has been omitted. However, the scope is not limited to the disclosed embodiments, and those skilled in the art may easily suggest other embodiments within the same scope of the idea.

Air conditioners are home appliances that maintain indoor air at a most proper state according to a use and purpose thereof. For example, air conditioners may maintain indoor air in a cool state in summer and a warm state in winter. Further, air conditioners may control a humidity of indoor air and adjust indoor air to a pleasant, clean state. Such an air conditioner, in which a refrigeration cycle is driven, may include, for example, a compressor, a condenser, an expansion device, and an evaporator.

Such an air conditioner may further include a suction device that suctions air within an indoor space, a heat exchanger that exchanges heat with the air suctioned via the suction device, and a discharge part that discharges the air heat-exchanged in the heat exchanger into the indoor space.

Also, the air conditioner may include a blowing fan that generates an air flow from the suction device to the discharge part.

When power of the air conditioner is ON and a command for execution of a specific mode is input, the compressor and the blowing fan may be driven to perform a cooling cycle corresponding to the specific mode. The specific mode may include, for example, a cooling mode, a warming mode, and a dehumidification mode.

Typical air conditioners are configured such that a user directly operates an input provided in or on the air conditioner, so as to select a specific mode. Such air conditioners may be provided with a display, on which information (hereinafter referred to as "operation information") on an operation of the air conditioner may be displayed. When the input is operated, a changed figure of the operation information may be displayed.

In the case of typical air conditioners, as the input is a button type, it may be inconvenient for a user to operate. Also, a window of the display changed whenever a button is pushed may be difficult to operate, and thus, a user may not easily operate the air conditioner. Therefore, many interests are focused on easily implementing the configuration of the input and the display to operate the air conditioner.

Figure 2:
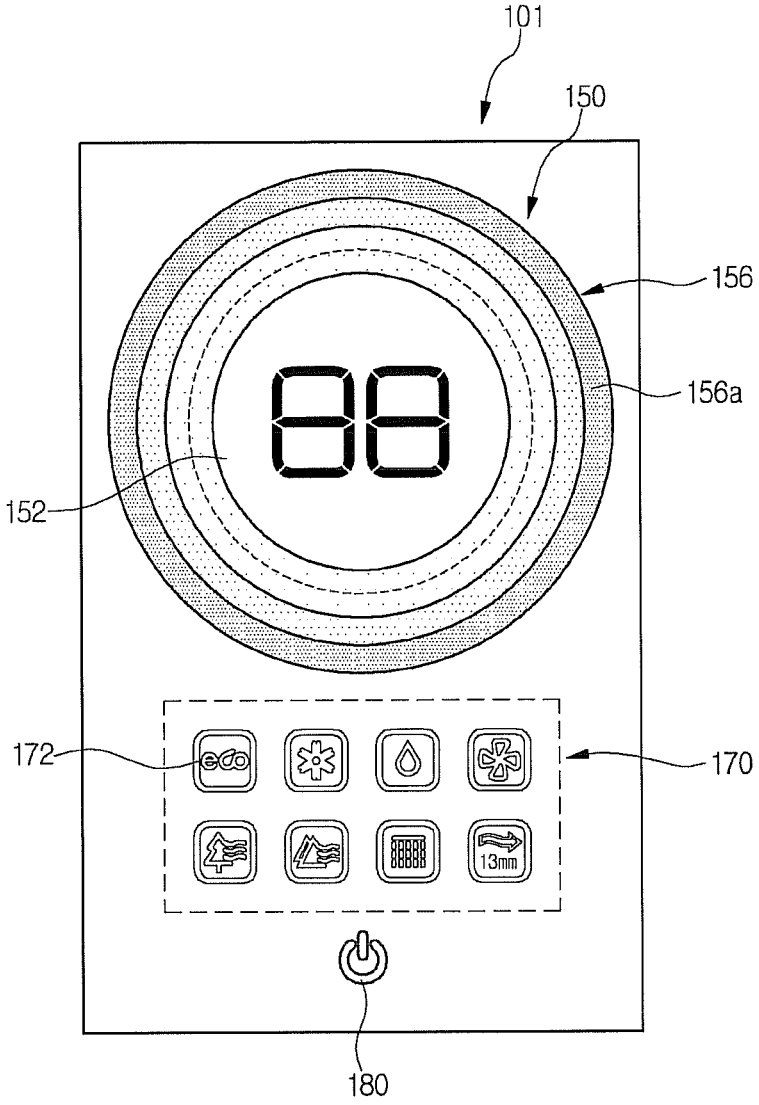
FIG. 2 is a schematic view of a display of FIG. 1.

FIG. 1 is a schematic perspective view of an air conditioner according to an embodiment, while FIG. 2 is a schematic view illustrating a display of FIG. 1.

Referring to FIG. 1, an air conditioner 10 according to this embodiment may include a suction part 12, a discharge part 15, and a case 11 that forms an appearance thereof. The air conditioner 10 of FIG. 1 may be an indoor device installed in an indoor room to discharge air therein.

The suction part 12 may be formed at a lower side of the case 11. A suction vein 13 to open or close the suction part 12 may be provided at one side of the suction part 12. The suction vein 13 may be rotatably disposed.

The discharge part 15 may be formed at an upper side of the case 11. A discharge vein 16 to open or close the discharge part 15 may be provided at one side of the discharge part 15. The discharge vein 16 may be rotatably disposed.

A front panel 20 may be provided on a front side of the case 11. The front panel 20 may be provided with a display 101 that displays information on an operation of the air conditioner 10. The display 101 may be a, for example, touch screen type display.

Referring to FIG. 2, the display 101 according to this embodiment may include an area (display area) that displays predetermined information, and an area (input area) to input a user's command. In more detail, the display 101 may include a power input interface 180 to select ON/OFF of the air conditioner 10, a mode input interface 170 to select operation modes for the air conditioner 10, and a wheel input interface 150, which may have a wheel shape.

The power input interface 180 may be disposed at a lower side of the display 101. The power input interface 180 may maintain a status displayed on the front panel 20 regardless of an ON/OFF status of the air conditioner 10.

The ON/OFF status of the air conditioner 10 may be selected via the power input interface 180. That is, pushing of the power input interface 180 one time may allow the air conditioner 10 to be changed to the ON status, and again pushing the power input interface 180 one time may allow the air conditioner 10 to be changed to the OFF status. The power input interface 180 may be lit brightly regardless of the ON/OFF status of the air conditioner 10.

The mode input interface 170 may define a portion of the display 101 and may be an input area selectable by a user. A mode display(s) 172, which may display one or more various operation modes of the air conditioner 10, may be included within the mode input interface 170. The mode display(s) 172 may be configured in an icon form including a predetermined shape(s) corresponding to an operation mode(s). Examples of various operation modes may include a cooling mode, a warming mode, an air cleaning mode, a power saving mode, a moisture removing mode, and a wind blowing mode, classified according to operations of the air conditioner.

The mode display(s) 172 may be an input selectable by a user while displaying a specific operation mode. That is, the mode display(s) 172 may be an input interface.

The mode input interface 170 may be a display which is not displayed on the front panel 20 when the air conditioner 10 is OFF, and which is displayed on the front panel 20 when the air conditioner 10 is ON. In more detail, a light source may be provided behind the mode input interface 170, and may be OFF when the air conditioner 10 is OFF and ON when the air conditioner 10 is ON.

An icon corresponding to a present operation mode may be configured so as to be discriminated from other icons. For example, the icon of a current operation mode may be indicated using the color yellow, and the remaining icons may be indicated using the color white, or the icon of the current operation mode may be indicated by a twinkling specific color and the remaining icons may be indicated by a cloudy specific color.

In summary, one operation mode may be selected through the mode input interface 170. That is, when one of one or more mode display(s) 172 is touched, the air conditioner 10 may be operated in an operation mode corresponding to the touched mode display, and the touched mode display 172 may be indicated by a different color or a brighter intensity of illumination so as to be discriminated from the other mode display parts.

The wheel input interface 150 may be an input that intuitively shows a user that the wheel input interface 150 may be operated in a rotation direction of the wheel, in order to input information on operations of the air conditioner 10. The wheel input interface 150 may define a position on the display 101 and may be an input selectable by a user. The wheel input interface 150 may have a circular or elliptical shape, an inside and outside of which may be divided by circumferential lines.

The wheel input interface 150 may include a temperature display 152 that displays information on a current temperature of an air conditioning space (indoor space) or a set temperature of the air conditioner 10, and a wind intensity display 156 that displays an intensity of wind or air flow discharged from the air conditioner 10. The temperature display 152 may be a display area on which a set temperature of the air conditioner 10 or a current temperature of an indoor space may be displayed. The temperature display 152 may be disposed at a center of the wheel input interface 150.

The wind intensity display 156 may include a plurality of circumferential lines **156*a* that enclose the temperature display 152. The circumferential lines 156*a* may have a circular or elliptical shape. At least one of the plurality of circumferential lines 156*a*** may be spaced apart from a neighboring circumferential line to enclose the neighboring circumferential line.

For example, the plurality of circumferential lines **156*a* may include four circumferential lines, as illustrated in FIG. 2. Of course, the number of the plurality of circumferential lines 156*a*** is not limited to four, but may be two, three, or more.

The plurality of circumferential lines **156*a* may be displayed brighter, for example, from an innermost circumferential line to an outermost circumferential line according to an intensity of the wind discharged from the air conditioner 10. For example, when the intensity of wind is weakest, the wind intensity display 156 may be configured such that the innermost circumferential line 156*a* is lit brightly, and when the intensity of wind is strongest, the wind intensity display 156** may be configured such that all of the four circumferential lines are lit brightly.

The wind intensity display 156 may function as a display area that displays the intensity of wind and at the same time as an input capable of recognizing a user's manipulation. For example, information on a set temperature value may be input through the display area of the wind intensity display 156.

In summary, the wind intensity display 156 may be configured such that the display area at least partially overlaps the input area. Description related to this function will be provided hereinbelow with reference to the accompanying drawings.

Figure 3:
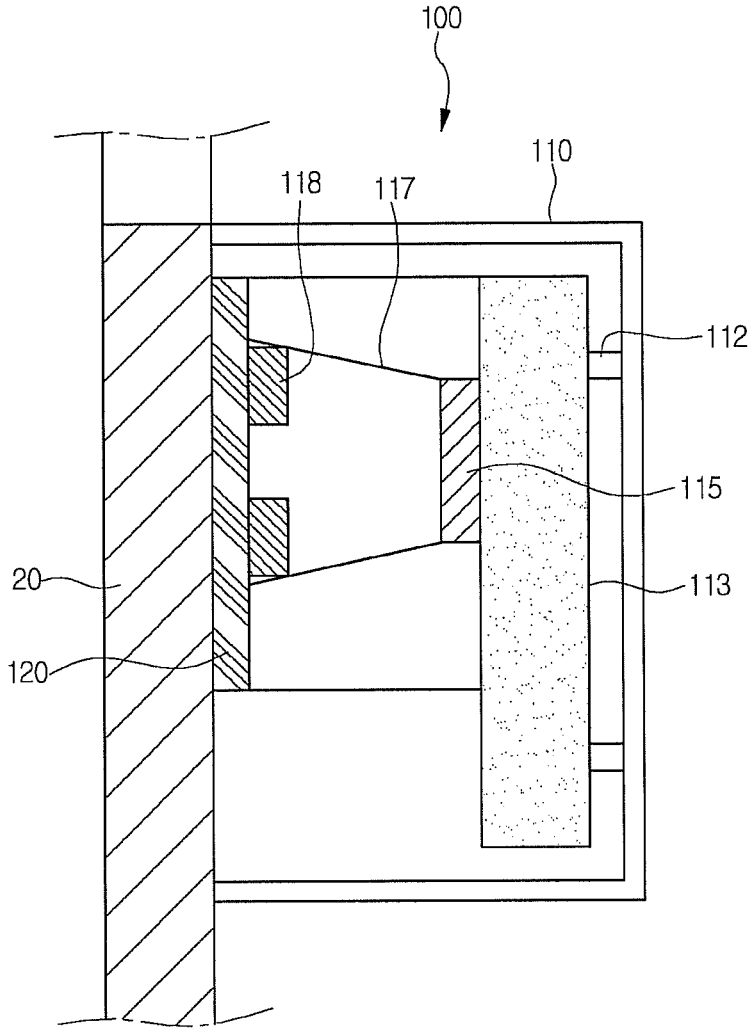
FIG. 3 is a sectional view of a display device according to an embodiment.
Figure 4:
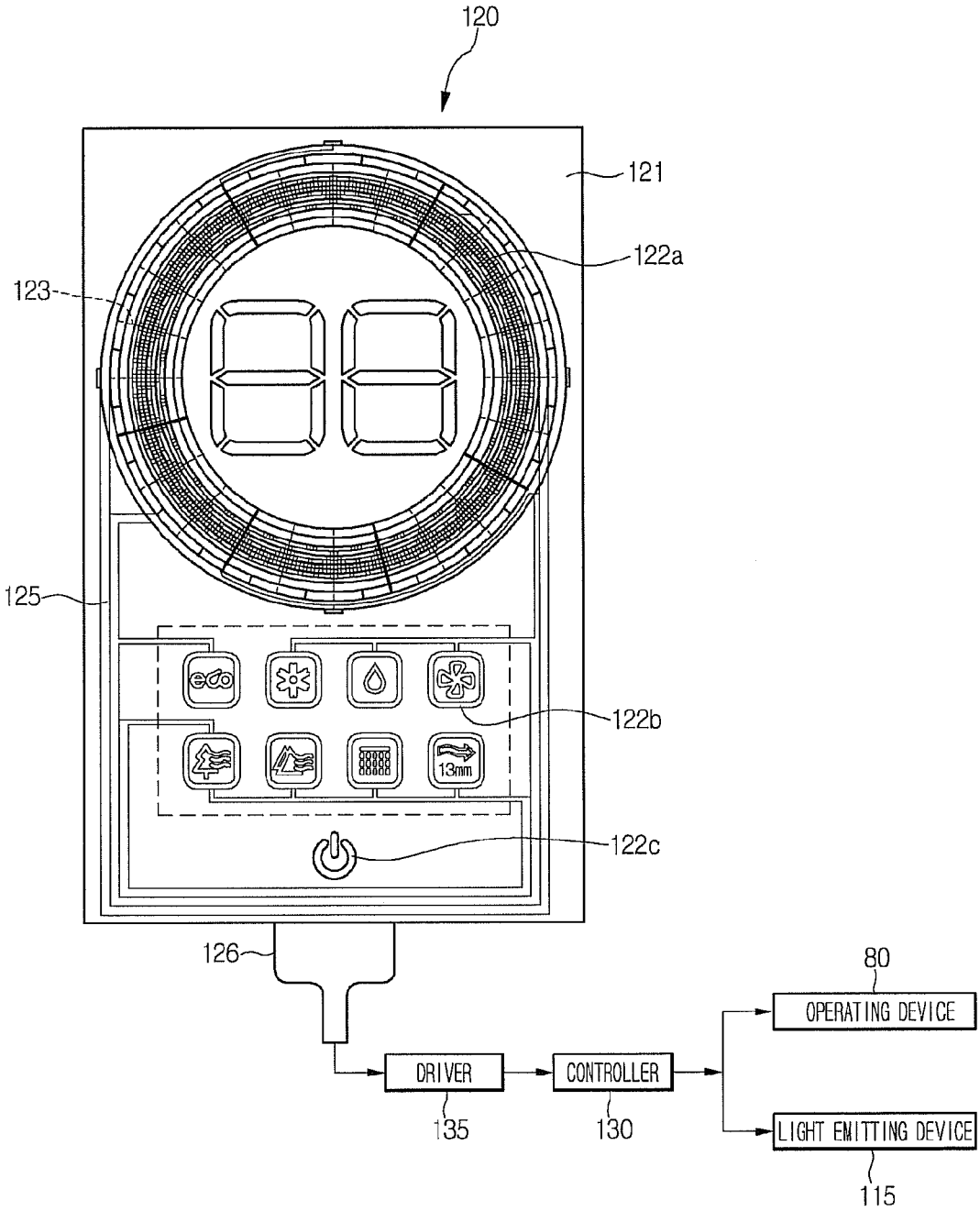
FIG. 4 is a schematic view of a film according to an embodiment.

FIG. 3 is a sectional view of a display device according to an embodiment. FIG. 4 is a schematic view of a film according to an embodiment.

Referring to FIG. 3, the air conditioner 10 according to this embodiment may be provided with a display device 100. The display device 100 may be a device disposed behind the front panel 20 to form the display 101.

The display device 100 may include a control box 110 coupled to the front panel 20 behind the front panel 20, and a printed circuit board (PCB) 113 disposed within the control box 110 and provided with a controller 130 (see FIG. 4) that controls the display 101. The PCB 113 may be fixed in the control box 110 by one or more supporter 112.

The display device 100 may include a light emitting device 115 coupled to a front of the PCB 113, a reflector 117 that reflects light emitted by the light emitting device 115, a film 120 coupled to a front of the reflector 117, and a guide 118 that guides the light reflected by the reflector 117 toward the film 120. The light emitting device 115 may be, for example, a light emitting diode (LED).

When information is input through the front panel 20, the film 120 may recognize input of information and deliver the input information to the controller 130. The controller 130 may determine an area to be displayed based on the delivered information, to operate the light emitting device 115, such that information corresponding to the input information may be displayed to the outside through the display 101.

The light emitted from the light emitting device 115 may interact with the reflector 117 and the guide 118 and then move forward. The light may act on at least a portion of areas printed on the film 120, for example, the power input interface 180, the mode input interface 170, and the wheel input interface 150 to brightly light corresponding icons or patterns. As a result, the display 101 may be implemented on the front panel 20.

Referring to FIG. 4, patterns corresponding to the plurality of input interfaces 150, 170, 180 may be printed on the film 120 according to this embodiment. In more detail, the film 120 may include, for example, an indium tin oxide (ITO) film, and a pattern 125 may be provided on one side of the film 121. The film 121 may be a film made of ITO, which is a compound of an indium oxide ($In_2O_3$) and a tin oxide ($SnO_2$), and has a sheet resistance of not more than about 103 Ω/sq and a transmittance of not less than about 80%. The ITO film 121 may be configured by attaching an ITO film on a polyester film and then patterning the ITO film through etching.

Patterns corresponding to the input interfaces 150, 170, 180 of the display 101 may be printed on the film 121. In more detail, the film 121 may include a wheel print **122*a* corresponding to the wheel input interface 150, a mode print 122***b* corresponding to the mode input interface 170, and a power print 122*c* corresponding to the power input interface 180. The pattern 125 may be connected to the print 122*a*, 122*b*, and 122*c*, recognize information touched on the respective input interfaces 150, 170, and 180, and transmit the recognized information to an output terminal 126. The pattern 125 may be, for example, configured in a silver ink pattern.

The wheel print 122*a* may include a plurality of lattice 123 arranged spaced apart by a predetermined distance from one another so as to sense positions touched along circumferences of the wheel pattern. The plurality of lattice 123 may be referred to as "detection lines", in that they detect touched points. The plurality of lattice 123 may be distributed uniformly along an entire circle (or ellipse) of the wheel.

The plurality of lattice 123 may extend in a radial direction across the plurality of circumferential lines 156*a* formed in the wind intensity display 156. When a user touches the plurality of lattice 123 in a circumferential direction of the wheel input interface 150, a number of the lattice 123 touched may be detected. By touching the plurality of lattice 150 in the circumferential direction, the user may intuitively perceive that he (or she) rotates the wheel clockwise or counterclockwise.

Herein, the term "touch" may be defined by specific information being recognized in the air conditioner 10 when a touch tool, for example, a user's hand or a touch pen contacts the display 101 or is located within a set distance of the display 101.

For example, case specific information may be recognized by the air conditioner 10, including a case in which a change in pressure or charge (static capacitance) as touched is recognized. Hereinafter, the term "touch" will be described using this concept.

Although it is illustrated that the plurality of lattice 123 extend from an innermost to an outermost circumferential line of the plurality of circumferential lines 156*a*, the plurality of lattice 123 may further extend beyond the outermost circumferential line 156*a* by a set length, unlike the illustrated case. In such a case, the outermost circumferential line may be understood to constitute the outer circumferential surface of the wheel input interface 150. However, even when a user touches the display 101 in a rotational direction of the wheel at a point spaced apart by a set distance from the outer circumferential surface of the wheel input interface 150, it may be recognized whether or not the corresponding lattice 123 is touched. In such case in which the wheel input interface 150 is touched in the outer circumferential (rotational) direction, it may be recognized which lattice 123 is touched, and this recognized information may be transmitted to an output terminal 126 through the pattern 125.

The mode input interface 170 corresponding to the mode print 122*b* and the power input interface 180 corresponding to the power print 122*c* may be configured such that they recognize whether or not a specific point is touched. Therefore, when the touch of one of the mode display(s) 172 or the power input interface 180 is recognized, whether or not to select the corresponding icons may be determined according to a change in pressure or static capacitance.

The input information transmitted to the output terminal 126 may be delivered to the controller 130 via a driver 135. The driver 135 may be, for example, a driver IC, and may be a device that provides an input signal or input data as an electrical signal.

The driver 135 may be configured to have a plurality of keys according to a color or size to be displayed. The driver 135 and the controller 130 may perform signal transmission according to I2C communication protocol. The I2C communication protocol is a synchronous communication method, and may be understood to be a serial communication protocol.

The controller 130 may operate an operating device 80 based on the signal transmitted from the driver 135, control the operation of the air conditioner 10, and control the light emitting device 115 to display information on the corresponding operation on the display 101. The operating device 80 may include a compressor or a blowing fan.

Figure 5A:
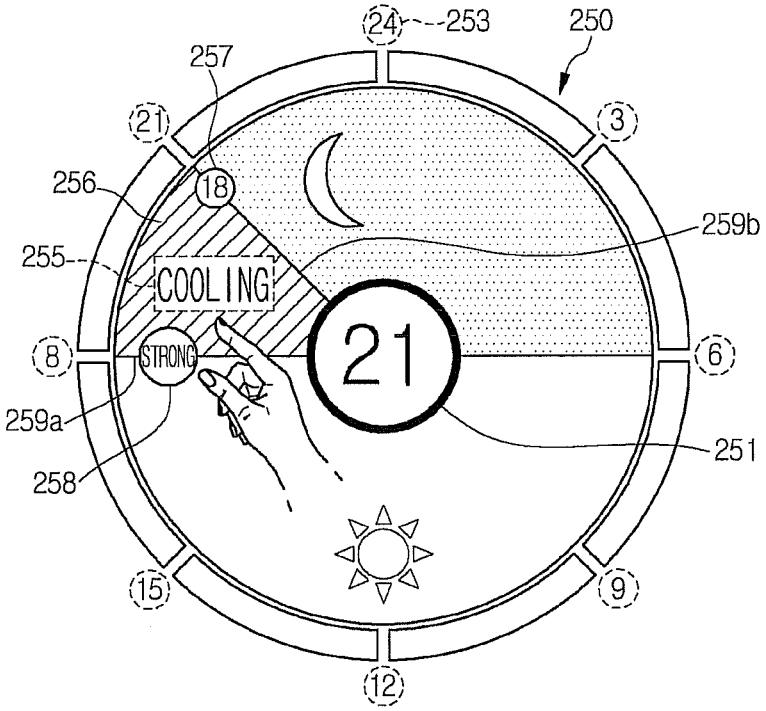
FIGS. 5A-5B are schematic views illustrating operation of a wheel input interface according to an embodiment.
Figure 5B:
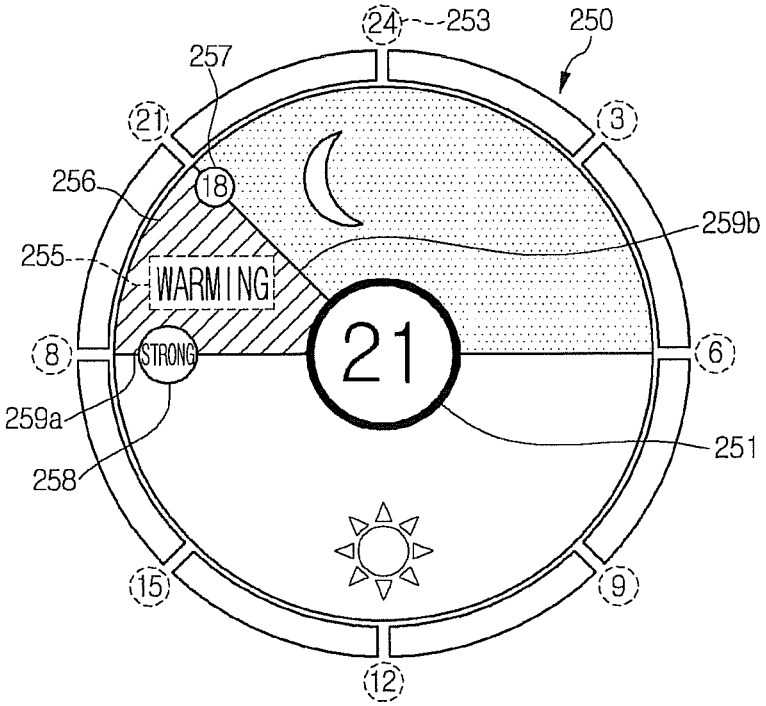

FIGS. 5A-5B are schematic views illustrating operation of a wheel input interface according to an embodiment. Referring to FIGS. 5A and 5B, a wheel input interface 250 according to this embodiment may include a time display 253 indicating operation time information along a circumferential direction, and a current temperature display 251 positioned at a center of the wheel to display a current temperature.

The time display 253 may display, for example, 24 hours a day along the circumferential direction. The wheel input interface 250 may further include a start time display 259*a* indicated by a line that extends in one direction from the temperature display 251 to a point on the time display 253, and an end time display 259*b* indicated by a line that extends in another direction from the temperature display 251 to another point on the time display 253. For convenience of explanation, the start time display 259*a* may be referred to as a "first line" and the end time display 259*b* may be referred to as a "second line".

The start time display 259*a* may indicate the operation start time of the air conditioner 10, and the end time display 259*b* may indicate the operation end time of the air conditioner 10. An inner area defined by the start time display 259*a* and the end time display 259*b* with respect to an entire inner area may correspond to an operation time of the air conditioner 10 with respect to a 24 hour day. In summary, the enclosed area formed by connecting the start time display 259*a*, the end time display 259*b*, and a portion of the circumference of the wheel input interface 150 may define an operation time area 256 indicating the operation time or reservation time of the air conditioner 10.

A color or intensity of illumination of the operation area 256 may be discriminated from the rest of the wheel input interface 250. For example, the operation time area 256 may be formed darker or brighter than other areas.

When a user touches the time display 253 in a clockwise or counterclockwise manner or drag, the operation time or reservation time may be set through the touched position or distance of the lattice 123. In more detail, when a user starts to touch the start time display 259*a* or the end time display 259*b* and continues to touch the same in a disposition direction of the time display 253, for example, clockwise or counterclockwise, the start time display 259*a* or the end time display 259*b* may rotate. With this process, the operation time area 256 may be expanded or decreased.

An operation mode display 255 that displays an operation mode of the air conditioner 10 may be included within the operation time area 256. For example, the operation modes may include "cooling", "warming", "dehumidification", and "air cleaning".

A set temperature display 257 may be disposed on any one of the start time display 259*a* and the end time display 259*b*. The set temperature display 257 may be provided movable along the start time display 259*a* or the end time display 259*b*.

In more detail, when a user moves the set temperature display 257 in an outer direction thereof (away from the current temperature display 251) through a touch, the set temperature may be increased, and when a user moves the set temperature display 257 in an inner direction thereof (toward the current temperature display 251), the set temperature may be decreased.

At this time, recognition of the increase or decrease of the set temperature through a touch may be performed by recognizing a distance corresponding to a length direction of the lattice 123, and a temperature value displayed on the set temperature display 257 may be changed corresponding to the moved distance of the set temperature display 257.

A wind intensity display 258 may be disposed on the other of the start time display 259*a* and the end time display 259*b*. The wind intensity display 258 may be provided movable along the start time display 259*a* or the end time display 259*b*. The movement mechanism of the wind intensity display 259 may be similar to that of the set temperature display 257.

In more detail, when a user starts to touch the wind intensity display 258 and continues to move the same in the outer direction, the wind intensity may be strengthened, and when the user moves the wind intensity display 258 in the inner direction in the state that the wind intensity display 258 is touched, the wind intensity may be weakened. That is, the wind intensity display 258 may move in the touch direction.

For example, when the wind intensity display 258 is positioned at approximately a center on the start time display 259*a* or the end time display 259*b*, the wind intensity may be displayed as "middle" or "medium", when the wind intensity display 258 is positioned at an outer side on the start time display 259*a* or the end time display 259*b*, the wind intensity may be displayed as "strong", and when the wind intensity display 258 is positioned at an inner side on the start time display 259*a* or the end time display 259*b*, the wind intensity may be displayed as "weak".

In summary, the set temperature display 257 may be disposed movable on one of the lines of the start time display 259*a* and the end time display 259*b*, and the wind intensity display 258 may be movably disposed on the other one. In more detail, when a user moves the wind intensity display 258 in the outer direction, the wind intensity may be increased, and when a user moves the wind intensity display 258 in the inner direction, the wind intensity may be decreased. At this time, recognition of the increase or decrease of the wind intensity through a touch may be performed by recognizing a distance corresponding to a length direction of the lattice 123.

Thus, as the set temperature display 257 and the wind intensity display 258 may be provided on the start time display 259*a* or the end time display 259*b* to adjust the set temperature or wind intensity along the displays 259*a* and 259*b*, a user may input information on the operation of the air conditioner 10, intuitively and easily.

The operation mode displayed on the operation mode display 255 may be changed by touching the inner area of the operation time area 256 or the operation mode display 255. The operation mode display 255 may be disposed within the area defined by the first line and the second line of the wheel input interface 250 and the circumferential surface of the wheel input interface 250.

As described above, first information on the operation of the air conditioner may be displayed on the first line, and second information on the operation of the air conditioner may be displayed on the second line. For example, the first information may be one of set temperature and discharged wind intensity of the air conditioner, and the second information may be the other.

In more detail, a plurality of preset operation modes may be defined in the air conditioner 10, and when the operation time area 256 or the operation mode display 255 is touched, one operation mode displayed on the operation mode display 255 may be changed into another operation mode and then displayed. To change the operation mode, the operation mode display 255 may be directly touched, or an area formed at an outer side of the operation mode display 255 in the inner area of the operation time area 256 may be touched. In this case, the controller 130 may change the content displayed on the operation mode display 255 based on the input information to control the operation of the air conditioner 10 according to the changed operation mode.

In summary, the operation mode display 255 may define the display area displaying information on the operation mode in the display, and the operation time area 256 enclosing the operation mode display 255 may be defined as an input to input information on the operation mode. For example, as illustrated in FIGS. 5A and 5B, while the air conditioner 10 is operated in the cooling mode, "cooling" may be displayed on the operation mode display 255, correspondingly to this mode. When a user touches an inner area of the operation time area 256 or the operation mode display 255, the displayed operation mode may be changed. That is, as illustrated in FIG. 5B, "cooling" may be changed to "heating". At this time, the sequence of the operation modes to be changed among the plurality of operation modes may be set in advance.

To change the display of the operation mode, the touching of the inner area of the operation time area 256 or the operation mode display 255 may be performed by touching the operation time area 256 once or maintaining the touched state during a set time or more. In a case in which the operation time area 256 is touched once, the display of the operation mode may be changed whenever touched. On the other hand, if the touched state of the operation time area 256 is maintained during a first set time or more, the display of the operation mode may be changed in a preset sequence. The time interval where the display of the operation mode is changed may be a second set time.

For example, the first set time may be about two seconds, and the second set time may be about one second. That is, when the operation time area 256 is touched for about two seconds or more, the change of the display of the operation mode may start. For example, the display may be changed in a sequence of cooling→warming→dehumidification→air cleaning. The time interval during which one operation mode may be changed to another operation mode, may be set to about one second.

According to the above configuration, as the operation mode display 255 may be disposed within the operation time area 256, the display of the operation mode may be easy and a user may easily confirm the operation mode. Also, as the operation mode display may be provided on a position within the wheel input interface and the operation mode may be changed by a touch and then viewed by a user, the display and change of the operation mode within a limited area may be made easy. Further, as the operation mode may be changed not only by touching the small operation mode display 255, but also by touching the operation time area 256, which is larger than the operation mode display 255, the display device may be convenient for a user to operate.

FIGS. 6A-6D are schematic views illustrating a display according to another embodiment. Referring to FIG. 6, a display 301 according to this embodiment may include a wheel input interface 350, which may have a circular or elliptical shape, and a mode input interface 370 provided on an outer side of the wheel input interface 350 to input the operation mode of the air conditioner 10.

Figure 6A:
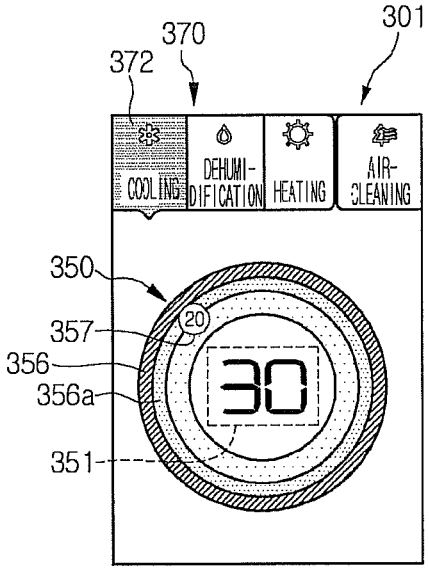
FIGS. 6A-6D are schematic views illustrating a display according to another embodiment.
Figure 6B:
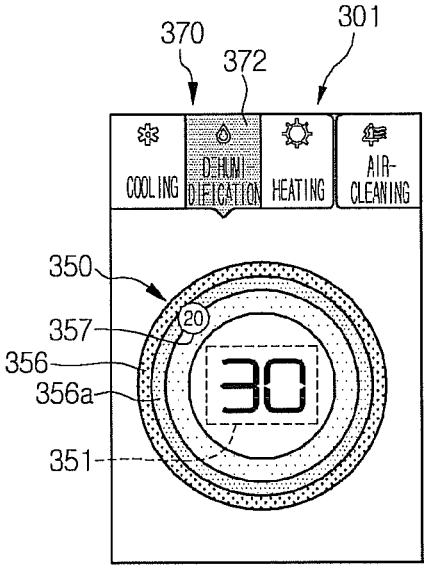
Figure 6C:
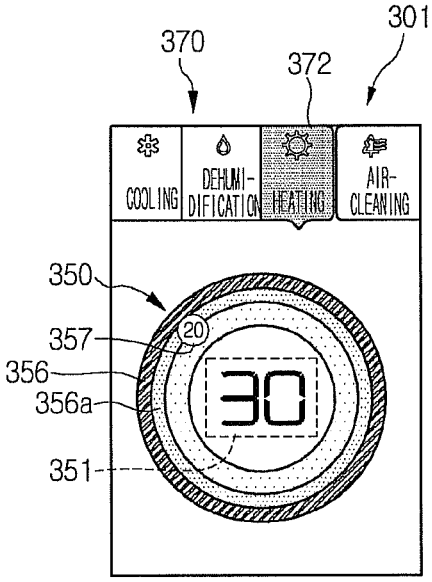
Figure 6D:
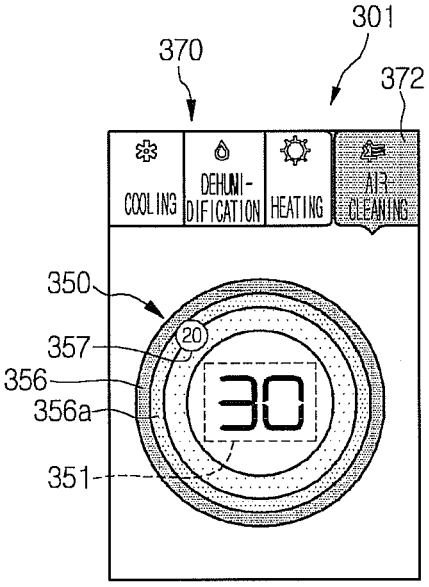

One or more mode display(s) 372 corresponding to one or more operation modes of the air conditioner 10 may be included within the mode input interface 370. The one or more mode display(s) 372 may form predetermined areas for input. As illustrated in FIG. 6A, the operation modes displayed may include, for example, "cooling", "dehumidification", "warming", and "air cleaning".

The wheel input interface 350 may include a current temperature display 351 provided on an inner center of the wheel input interface 350 to display a current temperature value, a wind intensity display 356 disposed to enclose the current temperature display 351 to display a degree of wind intensity, and a set temperature display 357 disposed at a portion of the wind intensity display 356 to display a set temperature value of the air conditioner.

The wind intensity display 356 may include a plurality of circumferential lines 356*a* having a closed circular or elliptical shape. Description on the plurality of circumferential lines 356*a* is similar that of the previous embodiment, and thus, repetitive disclosure has been omitted.

The mode display(s) 372 may be configured to be touch-input. That is, the mode display(s) 372 may be configured to display operation mode information and at the same time to enable a user to input the operation mode. That is, the mode display(s) 372 may be defined as an input area.

When one of operation modes included in the mode display (s) 372 is selected, the configuration of the wheel input interface 350 may be determined corresponding to the selected one mode. For example, the color of one of the plurality of circumferential lines 356*a* may be changed according to the selected operation mode. That is, the configuration of the circumferential line 356*a* corresponding to the respective operation mode may be changed.

For example, FIGS. 6A to 6D illustrate the configuration of the display 301 as selected in a sequence of cooling, dehumidification, warming, and air cleaning. As illustrated in the drawings, the color or texture of an outermost circumferential line of the plurality of circumferential lines 356*a* may be different according to the selected operation mode. That is, the configuration of the wheel input interface 350 may be displayed differently according to the selection of the input area (mode display(s)).

In summary, mode display(s) 372 capable of selecting the operation mode may be provided at an outer side of the wheel input interface 350. When one of the mode display(s) 372 is selected, the controller 130 may perform a control such that the configuration of the wheel input interface 350 is changed according to the selected mode display 372.

According to the above configuration, as a user may perform a touch and then confirm a control item of the air conditioner 10 through the display 301, product reliability may be enhanced.

Figure 7:
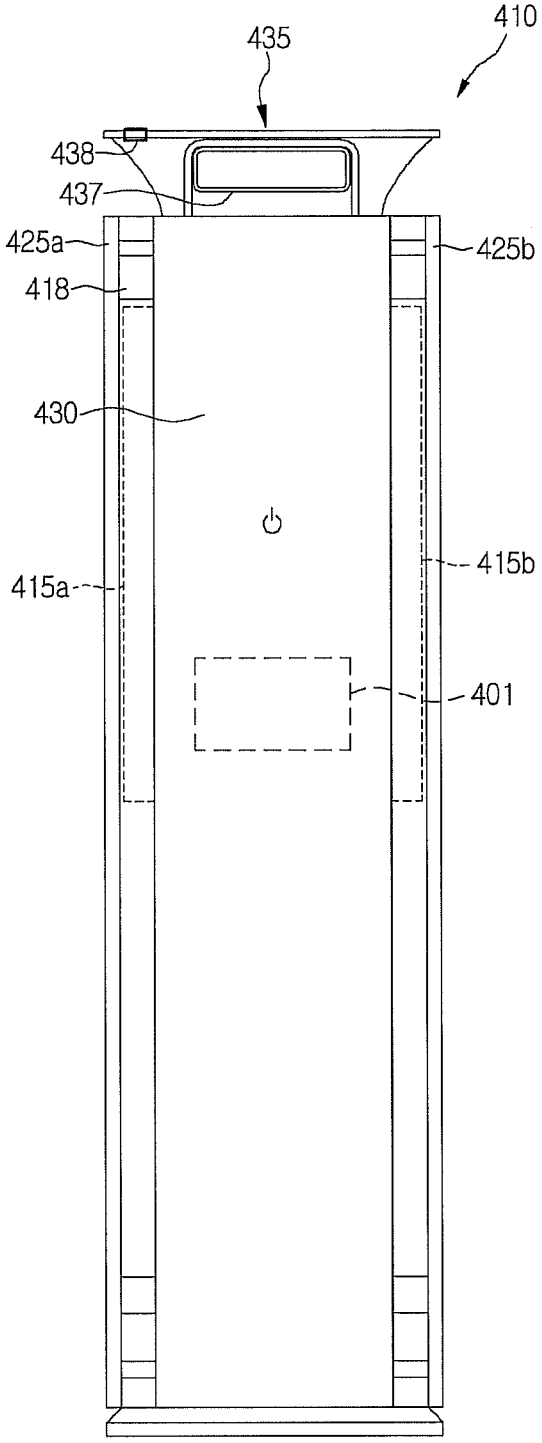
FIG. 7 is a schematic view of an air conditioner according to another embodiment.
Figure 8:
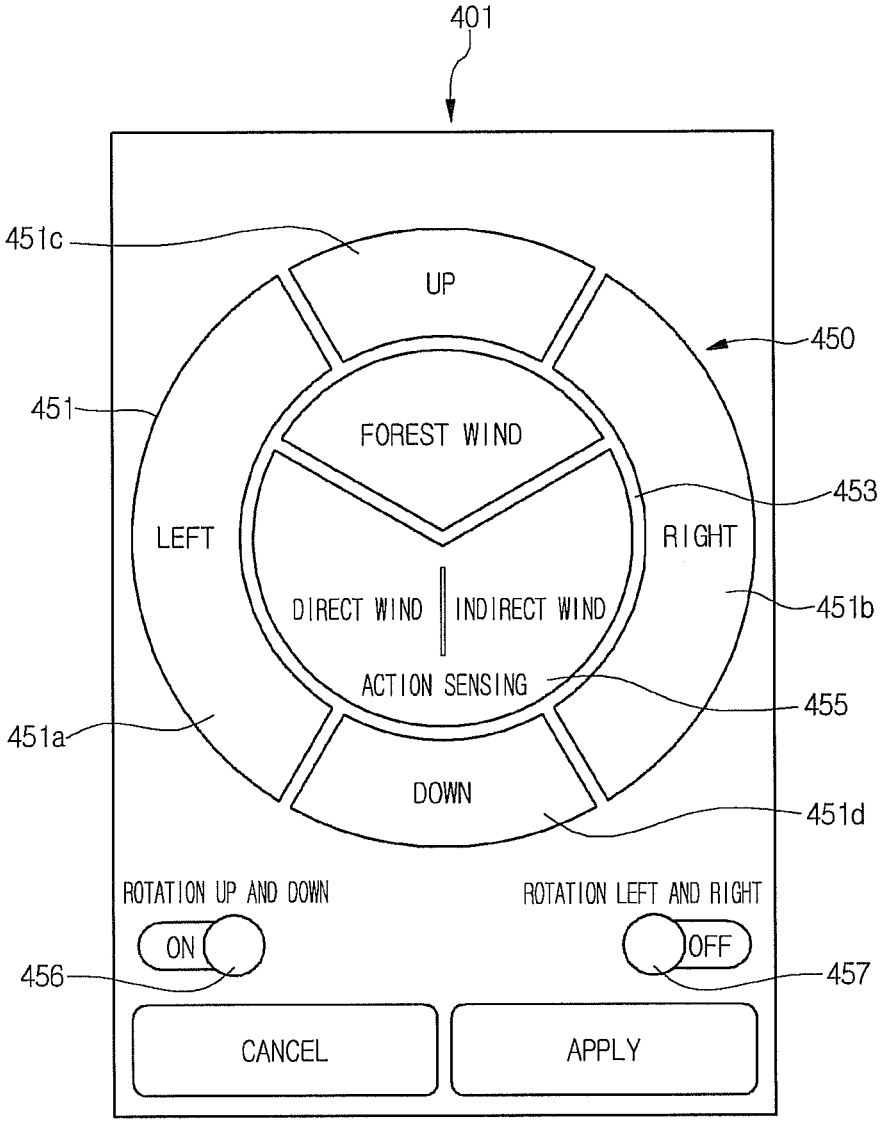
FIG. 8 is a schematic view of a display of the embodiment of FIG. 7.

FIG. 7 is a schematic view of an air conditioner according to another embodiment, while FIG. 8 is a schematic view of a display of the embodiment of FIG. 7. Referring to FIG. 7, an air conditioner 410 according to this embodiment may include a front panel 430, and a discharge part 415*a*, 415*b* disposed at both sides of the front panel 430 to discharge air. A discharge grille to prevent foreign particles from being introduced or discharged may be provided on or at each of the discharge parts 415*a* and 415*b*. The front panel 430 may be provided with a display 401. The discharge parts 415*a*, 415*b* may include a first discharge part 415*a* disposed at one side of the front panel 430, and a second discharge part 415*b* disposed at the other side of the front panel 430.

The air conditioner 410 may include a discharge panel 425*a*, 425*b* provided movable at one side of each of the discharge part 415*a*, 415*b*, respectively, to open or close the respective discharge part 415*a*, 415*b*. The discharge panel 425*a*, 425*b* may include a first discharge panel 425*a* and a second discharge panel 425*b* capable of opening or closing the first discharge part 415*a* and the second discharge part 415*a*, respectively. For example, when the first discharge panel 415*a* is closed and the second discharge panel 425*b* is opened, air may be discharged through the second discharge part 415*b* at one side, and when the first discharge panel 425*a* is opened and the second discharge panel 425*b* is closed, air may be discharged through the first discharge part 415*a* at the other side.

A discharge vein 418 is movably provided on the first discharge part 415*a* and the second discharge part 415*b*. The discharge vein 418 may be configured to control a flow direction of air discharged from the first discharge part 415*a* or the second discharge part 415*b*.

An upper discharge device 435 that discharges air may be provided on an upper side of the air conditioner 410. The upper discharge device 435 may be movable in up and down directions. In more detail, when the air conditioner 410 is operated, the upper discharge device 435 may protrude upward to discharge air, and when the air conditioner is not operated, the upper discharge device 435 may be received in or retracted into the air conditioner 410. Further, the upper discharge device 435 may be rotated in left and right directions so as to control the direction of discharged wind.

The upper discharge device 435 may include a discharge duct 437 provided tiltable in up and down directions. In a state that the upper discharge device 435 protrudes upward from the air conditioner 410, the discharge duct 437 may be tilted in up and down directions, to control the direction of discharged air in the up or down direction.

A sensor 438, such as a human body sensor, that senses whether or not a user (hereinafter referred to as an "indoor user") exists in an indoor space in which the air conditioner 410 is installed, or a position of an indoor user, may be provided on the upper discharge device 435. The sensor may be, for example, a pyroelectric infrared ray (PIR) sensor.

The display 401 may include a wheel input interface 450, which may have a circular or elliptical shape, and rotation selection interface(s) 456, 457 capable of adjusting a rotational direction of the upper discharge device 435.

The wheel input interface 450 may include a direction adjusting interface 451 capable of adjusting the direction of air discharged from the air conditioner 10. The direction adjusting interface 451 may include a plurality of direction adjusting interface portions 451*a*, 451*b*, 451*c*, 451*d* divided into four directions along the circumferential direction of the wheel input interface 450. The plurality of direction adjusting interface portions 451*a*, 451*b*, 451*c*, 451*d* may include a first direction adjusting interface portion 451*a* that allows air to be discharged in a leftward direction of the air conditioner 410, a second direction adjusting interface portion 451*b* that allows air to be discharged in a rightward direction of the air conditioner 410, a third direction adjusting interface portion 451*c* that allows air to be discharged in an upward direction of the air conditioner 410, and a fourth direction adjusting interface portion 451*d* that allows air to be discharged in a downward direction of the air conditioner 410.

A user may select one of the plurality of direction adjusting interface portions to perform a control, such that air is discharged in a direction corresponding to the corresponding direction adjusting interface portion. The selecting of the direction adjusting interface portion may be performed by a one-time touch in an area in which the direction adjusting interface portion is disposed. The selected direction adjusting interface portion may be indicated using, for example, a different color or a different intensity of illumination so as to be discriminated from other direction adjusting interface portions. Thus, as the plurality of direction adjusting interface portions may be discriminated and arranged in the circumferential direction, a user may intuitively select one direction adjusting interface portions to adjust the discharge direction.

Along with the direction adjusting interface 451, a discharge mode selecting interface 453, which may be defined by a circular input area, may be provided. The circular discharge mode selecting interface 453 may be divided into a plurality of areas to display a plurality of mode selecting portions. The plurality of mode selecting portions may include, for example, "forest wind (first mode)", "direct wind (second mode)", and "indirect wind (third mode) as operation modes of the air conditioner 410, as illustrated in FIG. 8.

The operation modes may be divided according to an operating method of the operating device 80. The forest wind may be a mode in which sound hearable in the forest is output from the air conditioner 10 together with one operation method of the operating device 80. The direct wind and the indirect wind may be modes in which an indoor user is sensed by the sensor 438 and whether to directly discharge air toward the indoor user or indirectly discharge air to the indoor user may be determined.

The respective operation modes may define set areas, and when a user touches a corresponding area, the corresponding mode of the selected area may be determined as the operation mode of the air conditioner.

The rotation selection interface(s) 456, 457 may include an up and down rotation selection interface 456 capable of adjusting up and down rotation of the upper discharge device 350, and a left and right rotation selection interface 457 capable of adjusting left and right rotation of the upper discharge device 350. The rotation selecting selection interface (s) 456, 457 may be movable in a horizontal direction by touch, and thus ON/OFF may be controlled.

Figure 9:
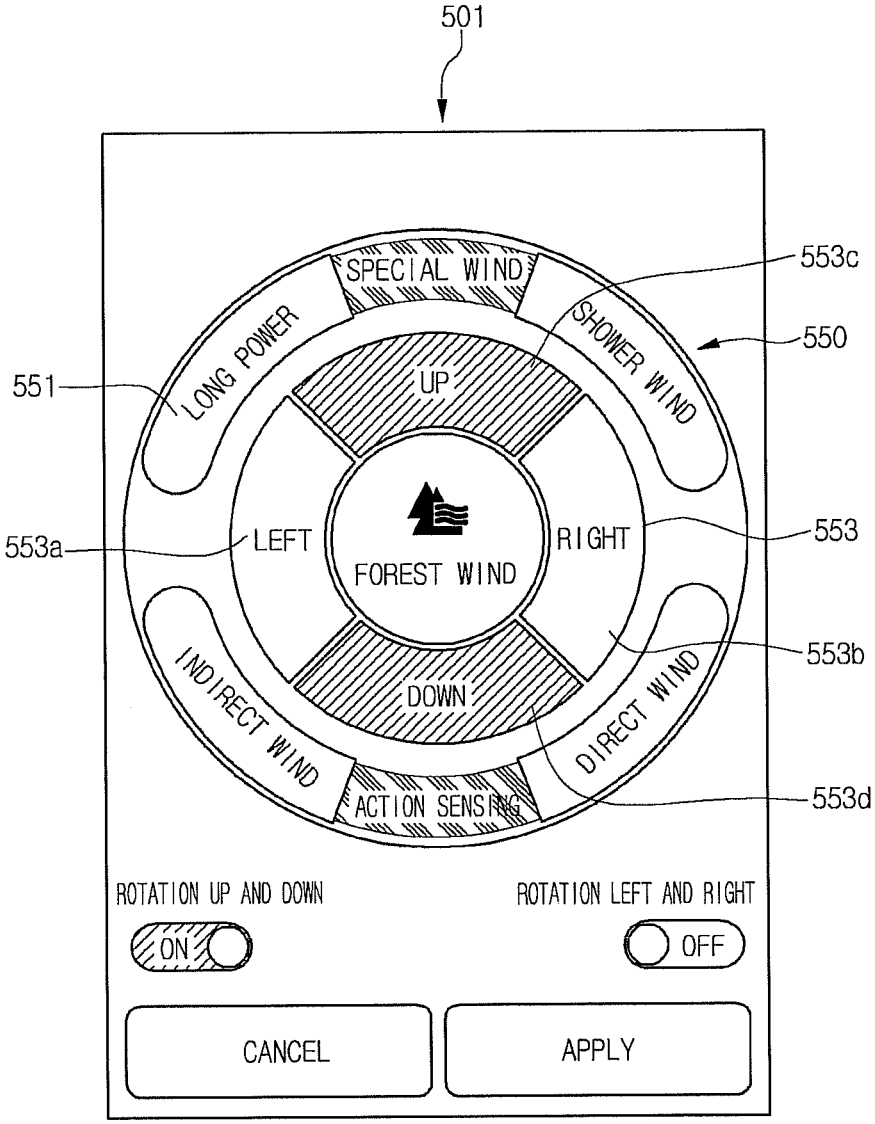
FIG. 9 is a schematic view illustrating a display according to another embodiment.

FIG. 9 is a schematic view illustrating a display according to another embodiment. A display 501 according to this embodiment may include a wheel input interface 550, which may have a circular or elliptical shape. The wheel input interface 550 may include a discharge mode selection interface 551 disposed in a circumferential direction of the wheel input interface 550, and a direction adjusting interface 553 disposed within the discharge mode selection interface 551 to adjust a discharge direction of air.

The discharge mode selection interface 551 may be divided into a plurality of set areas to display a plurality of operation modes. A user may select one operation mode by touching the area corresponding to an operation mode.

The direction adjusting interface 553 may be formed in an approximately circular shape, and may include a plurality of direction adjusting interface portions 553*a*, 553*b*, 553*c*, 553*d* arranged in up, down, left, and right directions. The plurality of direction adjusting interface portions may include a first direction adjusting interface portion 553*a* that allows air to be discharged in a leftward direction of the air conditioner 510, a second direction adjusting interface portion 553*b* that allows air to be discharged in a rightward direction of the air conditioner 510, a third direction adjusting interface portion 553*c* that allows air to be discharged in an upward direction of the air conditioner 510, and a fourth direction adjusting interface portion 553*d* that allows air to be discharged in a downward direction of the air conditioner 510.

The first to fourth direction adjusting interface portions 553*a*, 553*b*, 553*c*, 553*d* may be arranged at positions corresponding to the discharge directions of air to define input areas enabling input. Thus, as the plurality of direction adjusting interface portions are discriminated and arranged correspondingly to the discharge direction of air, a user may intuitively select one direction adjusting part to adjust the discharge direction.

According to embodiments disclosed herein, as it is possible to input information on the operation of the air conditioner via the wheel input interface, input may be easy and intuitive. Also, information change by an intuitive input may be easily confirmed on the display device.

Further, as it is easy and simple to input display information, users may conveniently operate the display device. Furthermore, as it is possible to input various information on operation of the air conditioner via the wheel input interface provided within a predetermined area, sizes of the input and the display may be miniaturized. In particular, as the display area is provided within an area enabling input, or the area enabling the input is provided within the display area, or the area enabling the input and the display area partially overlap each other, it becomes possible to efficiently use a limited area for implementation of an input and display.

Embodiments disclosed herein provide a display device of an air conditioner which is convenient to operate.

Embodiments disclosed herein provide a display device of an air conditioner that may include a film part or film including a displayable image; a controller that determines whether or not to display the displayable image on the basis of operation information recognized by the film part; a light emitting part or device that illuminates light toward the film part; and a display part or display provided on a panel of the air conditioner to enable a touch input, and operated by the light illuminated by the light emitting part. The display part may include a display area that displays operation information of the air conditioner, and an input area to input a command concerning the operation information. The controller may control the display part, such that the operation information displayed on the display area may be changed and displayed according to an input in the input area.

Embodiments disclosed herein provide a display device of an air conditioner that may include a display part or display that displays information concerning an operation of the air conditioner, and a controller that changes a content displayed on the display part on the basis of information input via the display part. The display part may include a wheel input part or interface having a circular or elliptical shape; an input area defined within the wheel input part to enable an input of information on the operation of the air conditioner; and a display area provided on one side of the input area to change a display content according to a content input into the input area.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A display device for an air conditioner, the display device comprising:

a display including a film configured to display an image corresponding to operation information of the air conditioner and that enables a touch input;

a controller that controls the display of the image; and a light emitting device that emits light toward the film, wherein the controller controls the display to display the image on the display, receives a command related to the operation information via the touch input, and controls a change of the image on the display according to the touch input, wherein the display comprises a wheel input interface provided on the film and having a circular or an elliptical shape, wherein a display area and an input disposed at an inner area of the wheel input interface, wherein the wheel input interface comprises:

a first line that extends in a first a center of the wheel input interface toward an outer circumference of the wheel input interface; and a second line that extends in a second direction from the center of the wheel input interface toward the outer circumference, and wherein the input area is defined by the first line and the second line.

2. The display device of claim 1, wherein the display device is configured to be provided on a panel of the air conditioner.

3. The display device of claim 1, wherein first information on the operation of the air conditioner is displayed on the first line, and wherein second information on the operation of the air conditioner is displayed on the second line.

4. The display device of claim 3, wherein the first information is movably displayed on the first line and the second information is movably displayed on the second line.

5. The display device of claim 3, wherein the first information is one of a set temperature of the air conditioner or an intensity of an air flow discharged from the air conditioner, and the second information is the other of the set temperature of the air conditioner or the intensity of the air flow discharged from the air conditioner.

6. The display device of claim 1, wherein the image displayed on the display includes an image corresponding to an operation mode defined in the air conditioner.

7. The display device of claim 6, wherein the operation mode comprises a plurality of operation modes, and wherein when an inside of the input area is touched, the image is changed in a predetermined sequence.

8. The display device of claim 1, wherein the input area of the wheel input interface comprises an input area that corresponds to an air discharge direction of an air flow of the air conditioner, and wherein the input area that corresponds to the air discharge direction comprises a plurality of direction adjusting interfaces, which is divided and disposed at positions corresponding to a plurality of discharge directions of the air flow.

9. The display device of claim 1, wherein, a plurality of patterns is printed on the film, wherein the plurality of patterns forms the wheel input interface and a mode input interface for input of the command related to the operation information.

10. The display device of claim 9, wherein the plurality of patterns includes a plurality of lattice that senses the touch input and communicates with the controller.

11. An air conditioner comprising the display device of claim 1.

12. A display device for an air conditioner, the display device comprising:

a display that displays content corresponding to an operation of the air conditioner; and a controller that changes the content displayed on the display based on information input via the display, wherein the display comprises:

a wheel input interface having a circular or an elliptical shape;

an input area defined within the wheel input interface to input information on the operation of the air conditioner, the input area including a line that extends in a radial direction from a center of the wheel input interface a toward an outer circumference of the wheel input interface; and a display area defined within the wheel input interface, on which a displayed content is changed according to content input in the input area, wherein the information displayed on the display area is changed while the line rotates on the center of the wheel input interface by a touch.

13. The display device of claim 12, wherein the display area forms at least a portion of an inside of the input area.

14. The display device of claim 12, wherein the line comprises a plurality of lines that extends in different direction from each other.

15. The display device of claim 12, wherein when the input area is touched, the information displayed on the display area is changed.

16. The display device of claim 15, wherein when the input area is touched one time the information displayed on the display area is changed in a predetermined sequence.

17. The display device of claim 15, wherein when the input area is touched for at least a predetermined period of time or more, the information displayed on the display area is changed in a predetermined sequence.

18. An air conditioner comprising the display device of claim 12.

* * * * *